US010731860B2

(12) United States Patent
Donovan et al.

(10) Patent No.: US 10,731,860 B2
(45) Date of Patent: Aug. 4, 2020

(54) AIR SHROUDS WITH AIR WIPES

(71) Applicant: Delavan Inc, West Des Moines, IA (US)

(72) Inventors: Matthew R. Donovan, Ankeny, IA (US); David H. Bretz, West Des Moines, IA (US); Philip E. Buelow, West Des Moines, IA (US)

(73) Assignee: DELAVAN, INC., West Des Moines, IA (US)

( * ) Notice: Subject to any disclaimer, the term of this patent is extended or adjusted under 35 U.S.C. 154(b) by 961 days.

(21) Appl. No.: 14/614,762

(22) Filed: Feb. 5, 2015

(65) Prior Publication Data

US 2016/0230997 A1 Aug. 11, 2016

(51) Int. Cl.

| | |
|---|---|
| ***F23R 3/28*** | (2006.01) |
| ***F23R 3/26*** | (2006.01) |
| ***F23R 3/14*** | (2006.01) |

(52) U.S. Cl.

CPC ..... *F23R 3/28* (2013.01); *F23R 3/14* (2013.01); *F23R 3/26* (2013.01); *F23R 2900/00004* (2013.01)

(58) Field of Classification Search

CPC ..... F23R 3/12; F23R 3/14; F23R 3/34; F23R 3/343; F23R 3/283; F23R 3/286; F23R 3/04; F23R 3/28; F23R 3/26; F23D 11/107; F23D 11/38; F23D 11/383; F02M 61/1813

See application file for complete search history.

(56) References Cited

U.S. PATENT DOCUMENTS

| | | | | |
|---|---|---|---|---|
| 4,946,105 | A | 8/1990 | Pane, Jr. et al. | |
| 5,044,559 | A | 9/1991 | Russell et al. | |
| 6,082,113 | A * | 7/2000 | Prociw | F23C 7/002 60/748 |
| 6,247,317 | B1 | 6/2001 | Kostka | |
| 6,474,569 | B1 * | 11/2002 | Brundish | F15C 1/08 239/404 |
| 7,926,281 | B2 * | 4/2011 | Commaret | F23D 11/107 60/737 |
| 2005/0217270 | A1 | 10/2005 | Sampath et al. | |
| 2009/0283611 | A1 * | 11/2009 | Varanasi | B05B 7/066 239/366 |
| 2010/0300102 | A1 * | 12/2010 | Bathina | F23R 3/12 60/737 |
| 2012/0210717 | A1 * | 8/2012 | Baruah | F23C 9/00 60/742 |

OTHER PUBLICATIONS

Extended European Search Report dated Jun. 21, 2016 issued during the prosecution of European Patent Application No. 16154547.0.

* cited by examiner

*Primary Examiner* — Jason H Duger

(74) *Attorney, Agent, or Firm* — Locke Lord LLP; Daniel J. Fiorello; Scott D. Wofsy

(57) ABSTRACT

An air shroud for a nozzle includes an air shroud body defining an inlet and an outlet in fluid communication with one another to allow an outer airflow to issue therefrom. The air shroud also includes an air wipe disposed outboard of the air shroud body including a web defining a plurality of air wipe outlets in fluid communication with a downstream surface of the air shroud body such that air can flow through the air wipe outlets and wipe the downstream surface of the air shroud body. The air wipe can be integral with the air shroud body.

15 Claims, 9 Drawing Sheets

AIR SHROUDS WITH AIR WIPES

BACKGROUND

1. Field

The present disclosure relates to air shrouds for nozzles, more specifically to air shrouds for fuel nozzles such as in gas turbine engine fuel injectors.

2. Description of Related Art

Fuel nozzles allow for mixing of fuel and air for injection into a combustor. Due to the turbulent nature of the flow-field, some of the liquid fuel spray from the fuel nozzle will wet the metal surfaces of the fuel nozzle which are exposed to the hot combustion gases. If the fuel temperature on the surface of the metal is in the proper range (about 200° C. to about 400° C. for jet fuel), then fuel will chemically break down to form carbon deposits on the metal surfaces. This can occur on the exposed surfaces of fuel pre-filmers and/or air-caps (also called air-shrouds). Carbon-formation on these metal surfaces is undesirable because this can adversely affect spray and combustion performance. Also, this carbon can sometimes break free from the metal surface and flow downstream where it can come into contact with the turbine and cause turbine erosion, which shortens the life of the turbine. In other cases, the exposed metal surfaces of the fuel nozzle (most commonly the air-shrouds) are subject to excessive heating from the combustion gases, which can result in thermal erosion or cracking of the metal.

A common method to alleviate either the problem of carbon-formation or thermal-erosion is to add an additional (smaller) air-shroud outboard of the existing air-shroud. This smaller air-shroud is commonly called an air-wipe and serves the function of directing compressor-discharge air downward over the face of the first (larger) air-shroud to either preferentially prevent carbon-formation or alleviate thermal-erosion. In some cases, these air-wipes also experience thermal-erosion and require some method to manage the thermal load. Typically, a series of small holes through the air-wipe are added to provide additional cooler compressor-discharge air in order to reduce the thermal load. Often this will alleviate the problem, but not always. In some cases, it is difficult to get a sufficient amount of additional compressor-discharge air in the vicinity of the air-wipe. In other cases, the thermal loading results in differential thermal expansion of the air-wipe which results in cracking and reduced life of the fuel nozzle, or possible damage to the turbine due to the air-wipe liberating from the fuel nozzle and traveling downstream through the turbine. Therefore, there is still a need in the art for improved air-wipes. The present disclosure provides a solution for this need.

SUMMARY

An air shroud for a nozzle includes an air shroud body defining an inlet and an outlet in fluid communication with one another to allow an outer airflow to issue therefrom. The air shroud also includes an air wipe disposed outboard of the air shroud body including a web defining a plurality of air wipe outlets in fluid communication with a downstream surface of the air shroud body such that air can flow through the air wipe outlets and wipe the downstream surface of the air shroud body. The air wipe can be integral with the air shroud body.

The web can include axial air outlets that allow air travel from an upstream side of the air shroud body through the air wipe and out the axial air outlets away from the downstream surface of the air wipe. At least one of the axial air outlets can be angled relative to an axial direction of the air shroud. This method of providing cooling air holes for the air-wipe can have the advantage that the air is independent of the air which flows over the downstream face of the air-shroud.

The air wipe outlets can be angled to direct air in a generally radial direction toward a central axis of the air shroud. The air wipe outlets can be angled to direct air in a generally tangential direction relative to a central axis of the air shroud.

The downstream surface of the air shroud body can be axially angled. In certain embodiments, the downstream surface of the air shroud body is conical.

A fuel nozzle includes a nozzle body defining a fuel circuit connecting a fuel inlet to a fuel outlet and including a prefilmer disposed in fluid communication with the fuel outlet, and an air shroud as described above disposed outboard of the prefilmer to direct air with fuel issued from the nozzle body.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
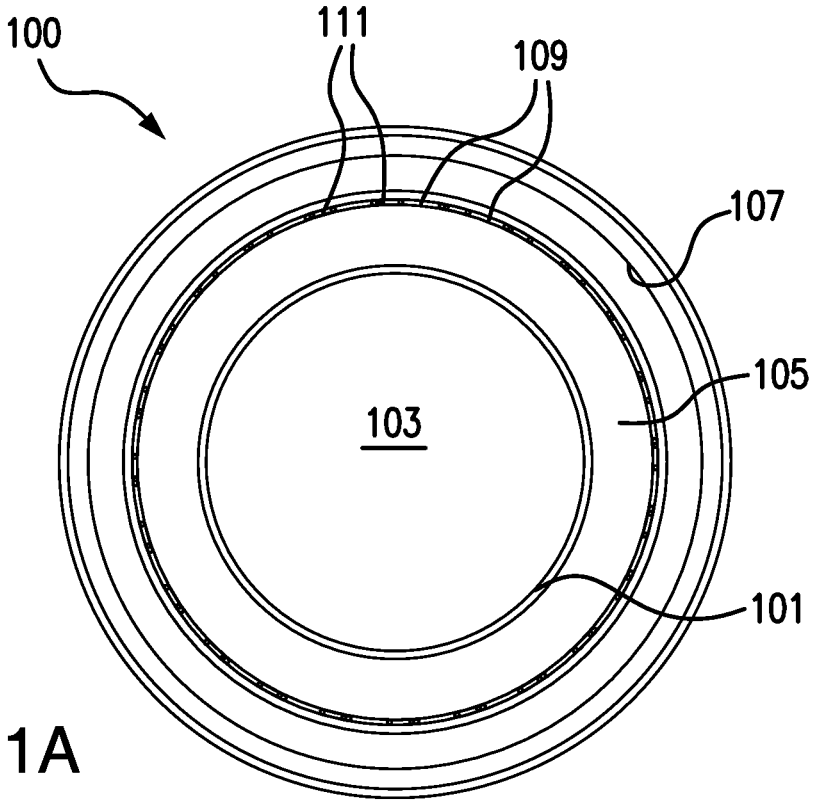
FIG. 1A is an outlet end elevation view of an embodiment of an air shroud in accordance with this disclosure, shown without airflow wiping a surface.
Figure 1B:
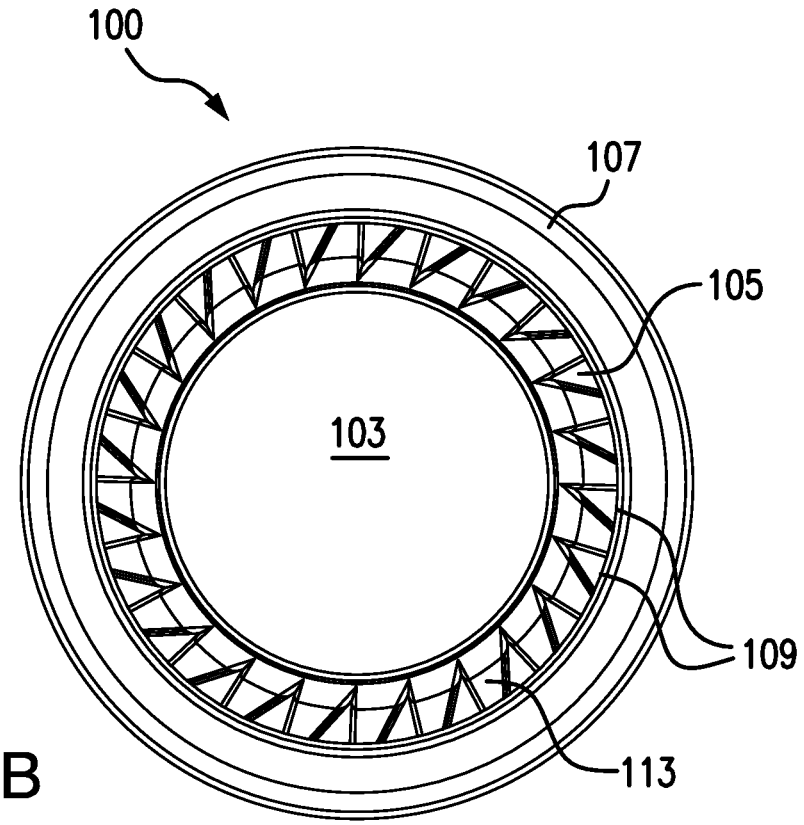
FIG. 1B is an outlet end elevation view of the air shroud of FIG. 1A, showing a portion of airflow wiping a surface.

Reference will now be made to the drawings wherein like reference numerals identify similar structural features or aspects of the subject disclosure. For purposes of explanation and illustration, and not limitation, an illustrative view of an embodiment of an air shroud in accordance with the disclosure is shown in FIG. 1A and is designated generally by reference character 100. Other embodiments and/or aspects of this disclosure are shown in FIGS. 1B-4C. The systems and methods described herein can be used to prevent or reduce carbon buildup on air shroud components, as well as reduce excessive thermal loading on the air shroud components in order to extend the life of the components. The systems and methods described herein can also be used to improve the structural integrity of the air-shroud components for extending the life of the components.

Figure 1C:
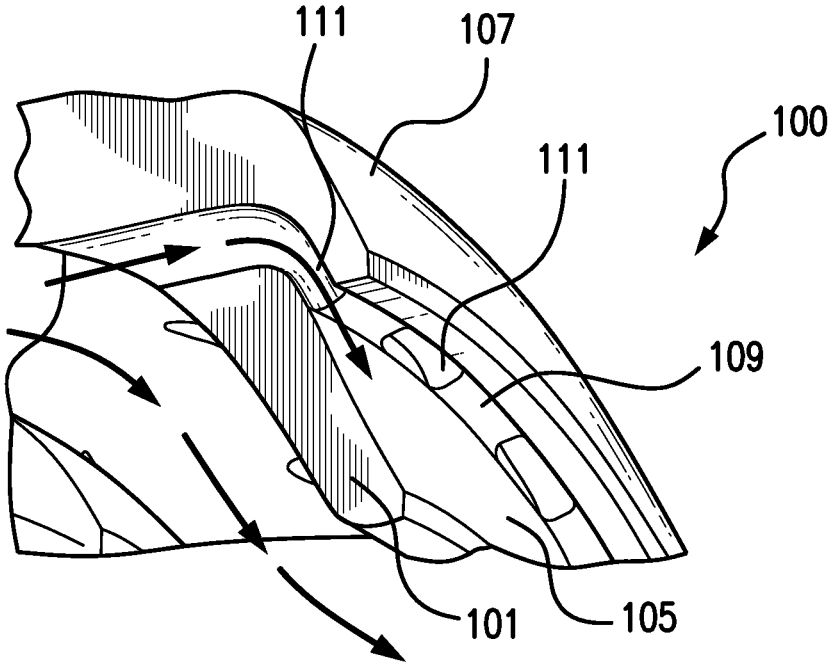
FIG. 1C is a perspective cross-sectional view of a portion of the air shroud of FIG. 1A showing the air wipe outboard of the air shroud body and flow therethrough.
Figure 1D:
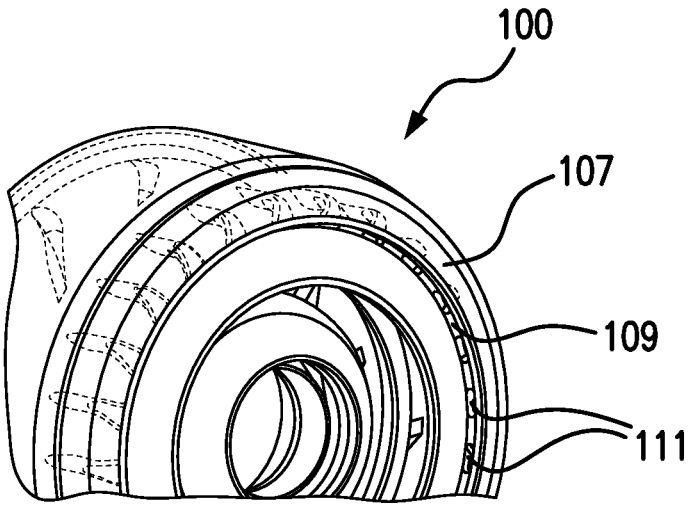
FIG. 1D is a perspective view of the air shroud of FIG. 1A, showing the air shroud disposed around a fuel nozzle.

Referring to FIGS. 1A and 1C, an air shroud 100 for a nozzle (e.g., fuel nozzle 400 as shown in FIG. 4) includes an air shroud body 101 defining a central mixing outlet 103 to allow a fuel-air mixture to be outlet therefrom. The air shroud body 101 has a downstream surface 105 facing the downstream direction relative to a flow through the air shroud 100. The downstream surface 105 of the air shroud body 101 can be axially angled in the downstream direction. For example, the downstream surface 105 of the air shroud body 101 can be conical.

The air shroud 100 also includes an air wipe 107 disposed outboard of the air shroud body 105 including a web of material 109 defining a plurality of air wipe outlets 111 in fluid communication with the downstream surface 105 of the air shroud body 101 such that air can flow through the air wipe outlets 111 and wipe the downstream surface 105 of the air shroud body 101.

As shown in FIGS. 1D, 2D, 3A, and 3B, the air wipe outlets 111 can fan out such that flow area increases closer to the shroud body 101. However, it is contemplated that the air wipe outlets 111 can have a constant flow area or any other suitable changing flow area. The web of material 109 which define the air wipe outlets are intended to extend far enough downstream to provide enhanced thermal contact between the air wipe 107 and the air shroud body 101, as well as increased structural integrity. The web of material 109 may extend all the way to the tip of the air wipe 107, but may also terminate upstream of the tip of the air wipe 107.

Figure 3A:
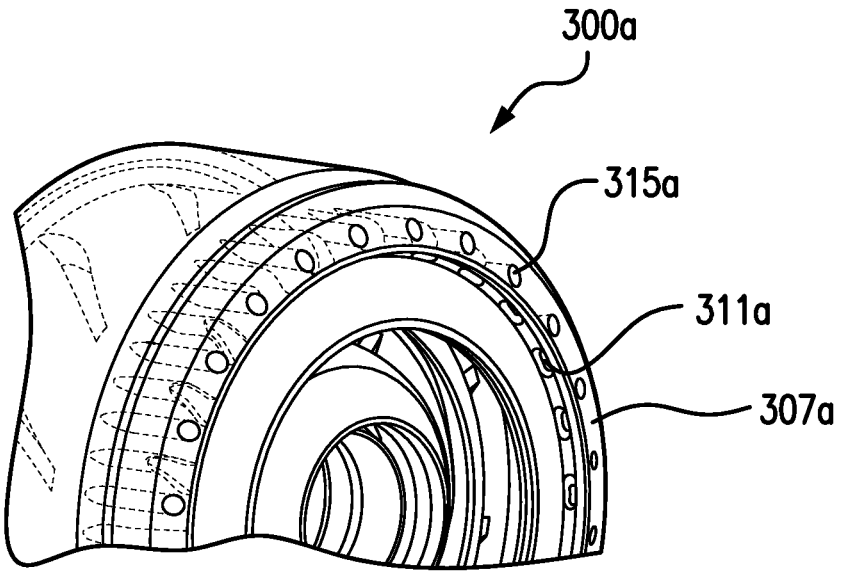
FIG. 3A is a perspective view of an embodiment of an air shroud in accordance with this disclosure, showing straight axial air outlets and non-tangentially angles air wipe outlets.
Figure 3B:
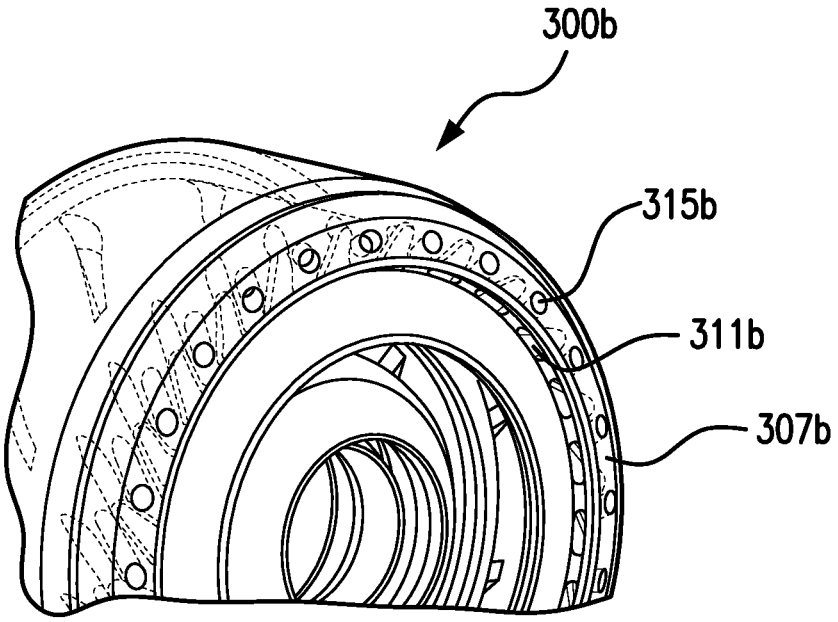
FIG. 3B is a perspective view of an embodiment of an air shroud in accordance with this disclosure, showing angled axial air outlets and tangentially angled air wipe outlets.

As shown in FIG. 1C, the air wipe outlets 111 can be angled to direct airflow 113 tangentially relative to a central axis A of the air shroud 100. The airflow 113 is shown as schematically exiting the air wipe outlets 111 on shroud 100 in FIG. 1B. Referring to FIG. 3A, however, it is contemplated that an air shroud 300*a* can have air wipe outlets 311*a* that can be angled to direct airflow normally or non-tangentially toward a central axis A (e.g., see FIG. 4C) of the air shroud 300*a*, i.e., the air wipe outlets 311*a* are angled to converge but not swirl a flow of wipe air issuing therefrom. Any suitable shape of air wipe outlets 111 is contemplated herein to allow a suitable direction of flow or combinations of directions of flow to wipe the downstream surface 105.

In certain embodiments, the air wipe 107 can be integral with the air shroud body 101. For example, it is contemplated that air shroud 100 can be manufactured using suitable additive manufacturing techniques. This can allow for complex shaped passages that cannot be formed using traditional manufacturing techniques (e.g., such that the channels can catch airflow from any suitable portion upstream and direct it in any suitable direction downstream). It is also contemplated that the air wipe 107 can be attached separately to the air shroud body 101 in any suitable manner (e.g., brazing or welding).

Referring to FIGS. 2A-2D, the web 209 of air shroud 200 can include one or more axial air outlets 215 in addition to air wipe outlets 211 to allow air travel from an upstream side of the air shroud body 201 through the air wipe 207 and out the axial air outlets 215 away from the downstream surface 205 of the air wipe. The axial air outlets 215 can be defined in the web 209 such that they are isolated from the air wipe outlets 211 preventing fluid communication therewith.

Axial air outlets 215 can be used to prevent burning and/or carbon buildup of the air wipe 207. As shown, the axial air outlets 215 can be directly fed with air from the upstream side of the air shroud 100 when isolated from air wipe outlets 211. In this manner, the air that flows over the downstream face 205 of the air-shroud 100 does not have to compete with the air that passes through air wipe outlets 211. This can lead to reduced loss of pressure for the air wipe outlets 211 and/or the axial air outlets 215 relative to traditional systems.

Figure 2A:
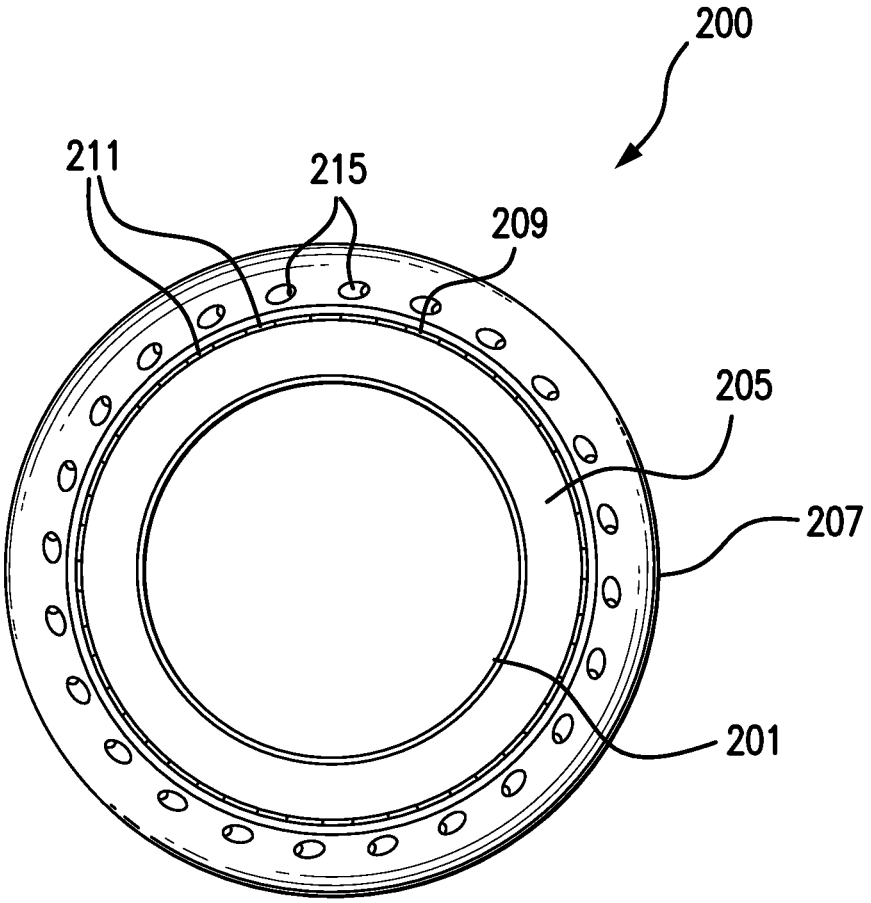
FIG. 2A is an outlet end elevation view of an embodiment of an air shroud in accordance with this disclosure, showing axial air outlets disposed in the air wipe.
Figure 2B:
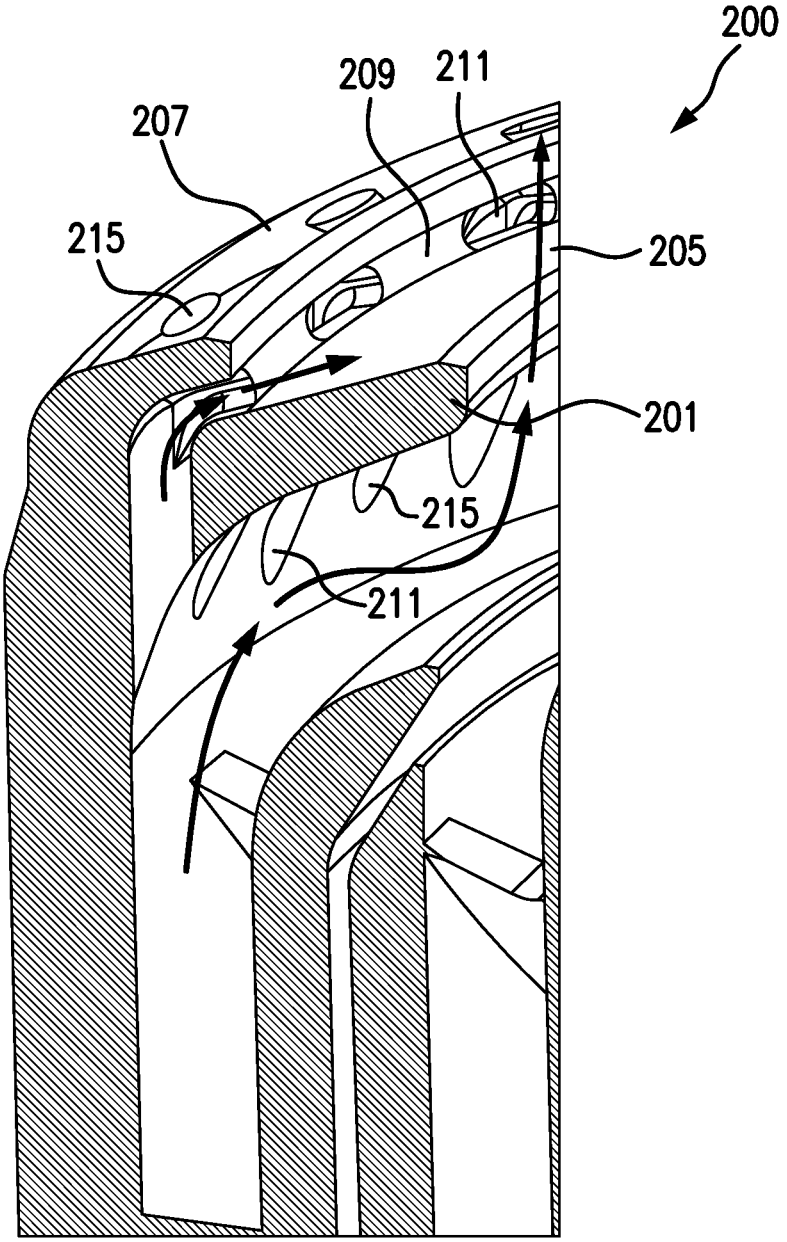
FIG. 2B is a perspective cross-sectional view of a portion of the air shroud of FIG. 2A showing the air wipe outboard of the air shroud body and flow through the air wipe outlets.
Figure 2C:
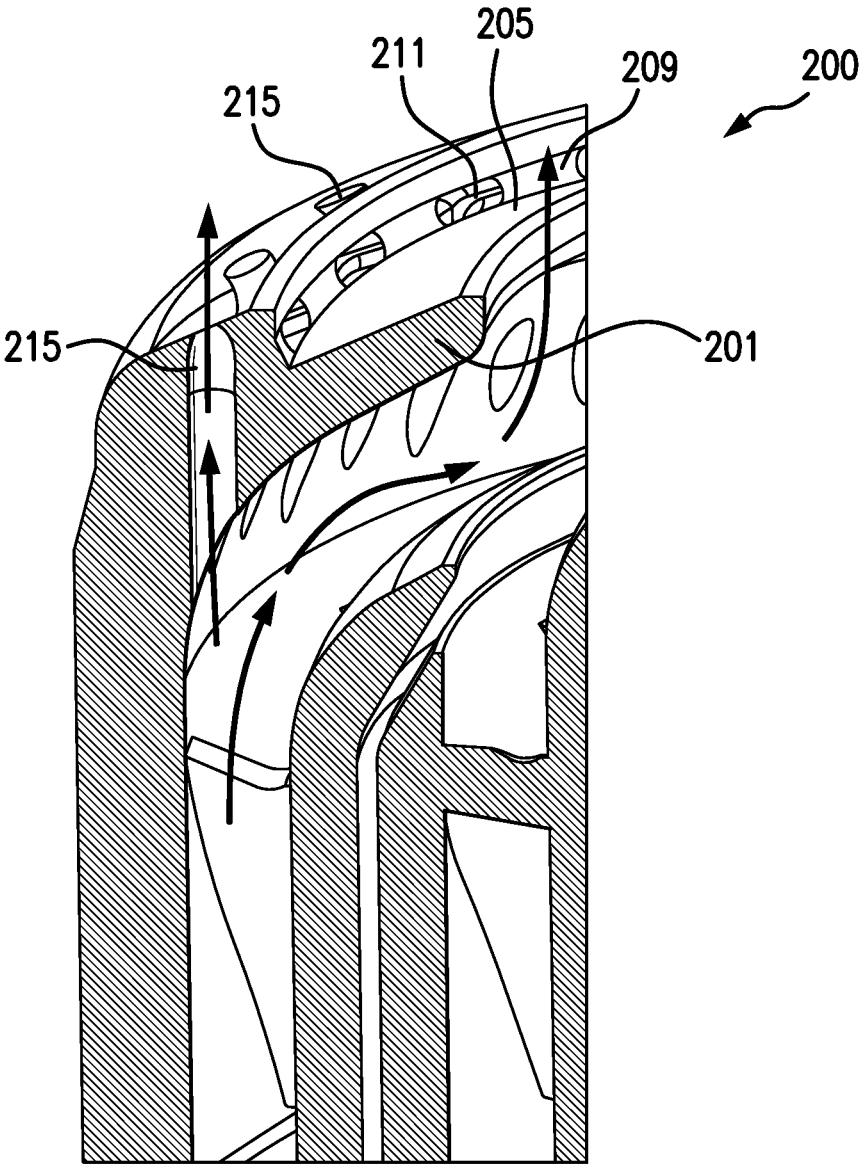
FIG. 2C is a perspective cross-sectional view of a portion of the air shroud of FIG. 2A showing the air wipe outboard of the air shroud body and flow through axial outlets.
Figure 2D:
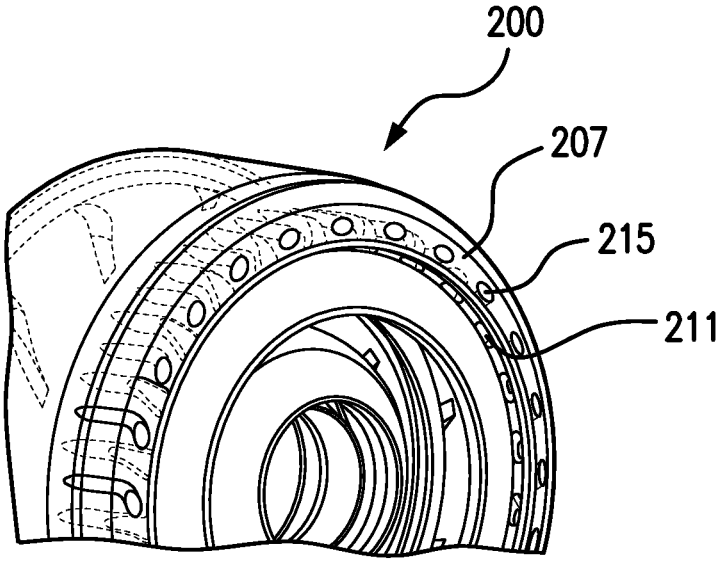
FIG. 2D is a perspective view of the air shroud of FIG. 2A, showing the air shroud disposed around a fuel nozzle.

Also, as shown, at least one of the axial air outlets 215 can be angled tangentially, i.e., to induce swirl, relative to an axial direction of the air shroud 200. It also is contemplated, as shown in FIG. 3A, that the axial air outlets 315*a* can be defined straight through the air wipe 307*a* in an axial direction. While FIGS. 2A and 3A show the axial air outlets 215, 315*a* in combination with non-tangentially angled air wipe outlets 211, 311*a*, any suitable combination of angles or lack thereof between one or more air wipe outlets 211, 311*a* and one or more axial air outlets 215, 315*a* is contemplated herein. For example, referring to FIG. 3B, an air shroud 300*b* can have air wipe outlets 311*b* that can be angled to direct airflow tangentially toward a central axis A (e.g., see FIG. 4C) of the air shroud 300*b* and also have angled axial air outlets 315*b*, i.e., the air wipe outlets 311*a* are angled to swirl a flow of wipe-air and axial-air issuing from the air wipe 307*b*.

Figure 4B:
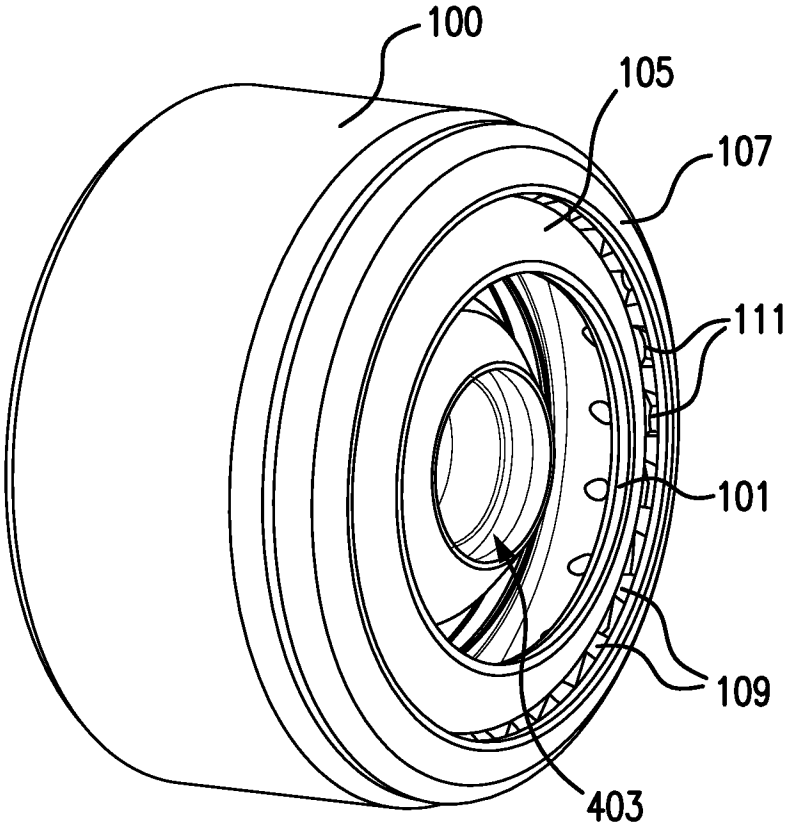
FIG. 4B is a zoomed view of a downstream end of the injector of FIG. 4A.
Figure 4A:
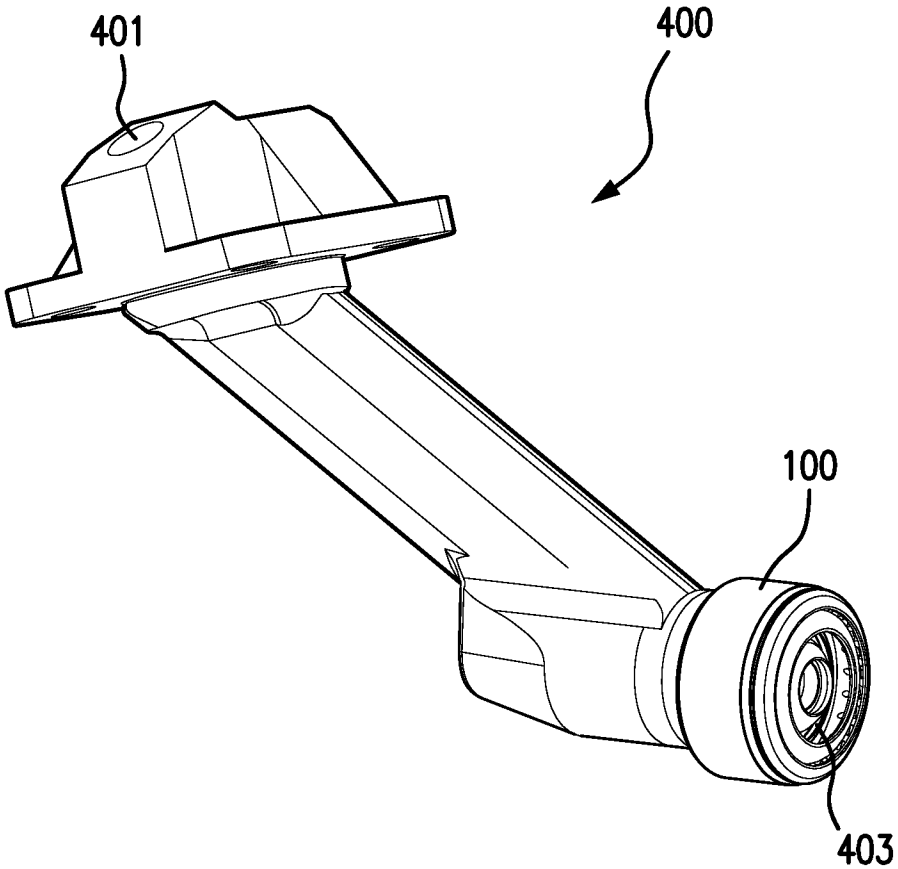
FIG. 4A is a perspective view of an injector in accordance with this disclosure, showing an embodiment of an air shroud disposed thereon.
Figure 4C:
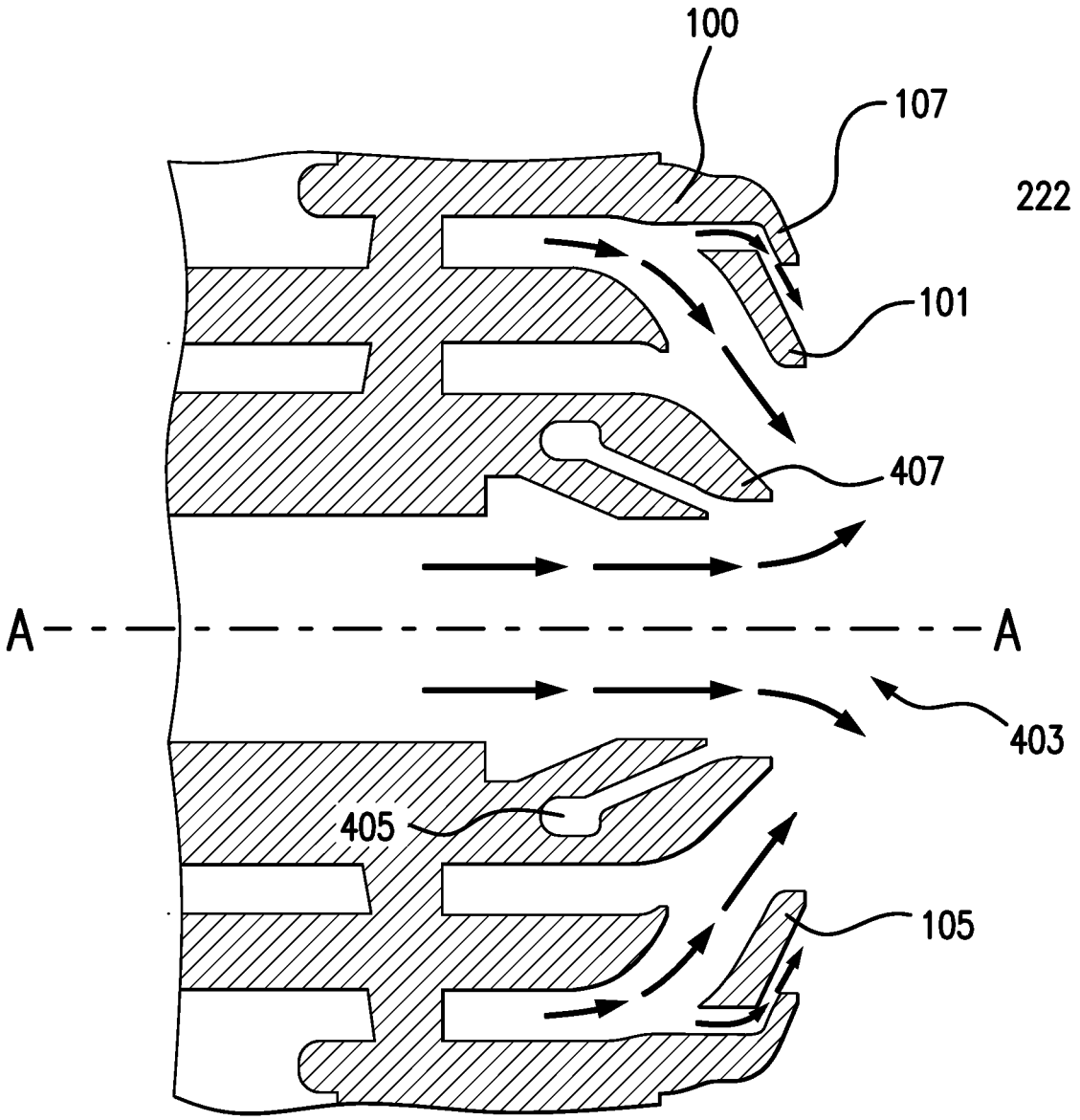
FIG. 4C is a side elevation cross-sectional view of the downstream end of the injector of FIG. 4A, showing flow therethrough.

Referring to FIG. 4A-4C, a fuel nozzle 400 includes a fuel inlet 401, a fuel outlet 403 in fluid communication with the fuel inlet 401 to inject fuel into a combustion chamber, and a fuel circuit 405 connecting the fuel inlet 401 to the fuel outlet 403. The fuel circuit 405 can include a prefilmer 407 disposed in fluid communication with the fuel outlet 403. The fuel nozzle 400 can include an air shroud as described above (e.g., air shroud 100 as shown) as described above disposed outboard of the prefilmer 407 to mix air with fuel ejecting from the fuel nozzle 400.

As described above, the air wipe 107 provides a wiping airflow that, under some conditions, helps remove fuel off of the downstream surface 105 of the air shroud body 101. Under other conditions (e.g., excessive heat load), the airflow also prevents further thermal erosion of the downstream surface 105. Finally, the web of material 109 between the air wipe passages/outlets 111 provide improved structural support to the air wipe 107. These features can increase the useable lifespan of the assembly and/or the time between required maintenance.

The methods and systems of the present disclosure, as described above and shown in the drawings, provide for air shrouds with superior properties including enhanced wiping for reducing carbon buildup and/or improved thermal management. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. An air shroud configured to surround a fuel nozzle body, comprising:

an air shroud body having an internal surface and a downstream surface, the internal surface defining an air passage and an outlet in fluid communication with one another, the outlet configured to issue a fuel-air mixture therefrom; and an air wipe disposed outboard of the air shroud body, the air wise including a circumferential web of material extending axially between the air wipe and the air shroud body, a plurality of air wipe outlets extending through the air shroud body and the circumferential web, each of the plurality of air wipe outlets having an entrance defined by the internal surface of the air shroud body and an exit defined by the circumferential web, the plurality of air wipe outlets and the air wipe configured to direct a flow of air inboard along the downstream surface of the air shroud body such that the flow of air wipes the downstream surface along an exterior of the air shroud body.

2. The air shroud of claim 1, wherein the air wipe is integral with the air shroud body.

3. The air shroud of claim 2, wherein the circumferential web includes axial air outlets that allow another flow of air to travel from the internal surface of the air shroud body through the air wipe and out the axial air outlets away from a downstream surface of the air wipe.

4. The air shroud of claim 3, wherein at least one of the axial air outlets is angled relative to an axial direction of the air shroud.

5. The air shroud of claim 1, wherein the downstream surface of the air shroud body is axially angled.

6. The air shroud of claim 5, wherein the downstream surface of the air shroud body is conical.

7. The air shroud of claim 1, wherein each of the plurality of air wipe outlets fans out adjacent the respective exit.

8. The air shroud of claim 7, wherein the air wipe extends longitudinally past the air shroud body and then turns radially inward.

9. The air shroud of claim 7, wherein the web terminates upstream and radially outward of a tip of the air wipe.

10. A fuel nozzle, comprising:

a nozzle body defining a fuel circuit connecting a fuel inlet to a fuel outlet and including a prefilmer disposed in fluid communication with the fuel outlet; and an air shroud surrounding the prefilmer configured to direct air toward fuel issued from the nozzle body, the air shroud including:

an air shroud body having an internal surface and a downstream surface the internal surface defining an air passage and an outlet in fluid communication with one another, the outlet configured to issue a mixture of the fuel and the air therefrom; and an air wipe disposed outboard of the air shroud body, the air wipe including a circumferential web of material extending axially between the air wide and the air shroud body, a plurality of air wipe outlets extending through the air shroud body and the circumferential web, each of the plurality of air wine outlets having an entrance defined by the internal surface of the air shroud body and an exit defined by the circumferential web, the plurality of air wipe outlets and the air wipe configured to direct a flow of air inboard along the downstream surface of the air shroud body such that the flow of air wipes the downstream surface along an exterior of the air shroud body.

11. The fuel nozzle of claim 10, wherein the air wipe is integral with the air shroud body.

12. The fuel nozzle of claim 11, wherein the circumferential web includes axial air outlets that allow another flow of air to travel from the internal surface of the air shroud body through the air wipe and out the axial air outlets away from a downstream surface of the air wipe.

13. The fuel nozzle of claim 12, wherein at least one of the axial air outlets is angled relative to an axial direction of the air shroud.

14. The fuel nozzle of claim 10, wherein the air wipe outlets are angled to direct the flow of the air at an angle relative to a central axis of the air shroud.

15. The fuel nozzle of claim 10, wherein the downstream surface of the air shroud body is axially angled.

* * * * *